US005397195A

United States Patent [19]

Goncalves

[11] Patent Number: 5,397,195

[45] Date of Patent: Mar. 14, 1995

[54] ASSEMBLY FOR THE DISPENSING AND THE APPLICATION OF A FLUID PRODUCT

[75] Inventor: Antonin Goncalves, Montmorency, France

[73] Assignee: L'Oreal, Paris, France

[21] Appl. No.: 263,837

[22] Filed: Jun. 22, 1994

[30] Foreign Application Priority Data

Jun. 25, 1993 [FR] France ..... 93 07762

[51] Int. Cl.[6] ..... A45D 34/00; A46B 11/02

[52] U.S. Cl. ..... 401/277; 401/116; 401/117; 401/269

[58] Field of Search ..... 401/277, 117, 116, 269

[56] References Cited

U.S. PATENT DOCUMENTS

| | | | |
|---|---|---|---|
| 4,279,527 | 7/1981 | Moe et al. . | |
| 4,726,386 | 2/1988 | Schultz | 401/277 X |
| 4,748,990 | 6/1988 | Brown et al. | 401/277 X |
| 4,854,758 | 8/1989 | Morel . | |
| 4,902,152 | 2/1990 | Seidler | 401/117 |
| 4,930,922 | 6/1990 | Zarosa et al. | 401/277 X |
| 5,004,127 | 4/1991 | Morel . | |

FOREIGN PATENT DOCUMENTS

| | | | |
|---|---|---|---|
| 0238391 | 9/1987 | European Pat. Off. . | |
| 0342109 | 11/1989 | European Pat. Off. . | |
| 1.555.567 | 1/1969 | France . | |
| 288125 | 5/1953 | Switzerland . | |
| 11541 | of 1913 | United Kingdom | 401/116 |

*Primary Examiner*—Steven A. Bratlie
*Attorney, Agent, or Firm*—Young & Thompson

[57] ABSTRACT

Assembly for the dispensing and the application of a fluid product, comprising a container (2) containing the product, an applicator holder (30) equipped with an applicator (38), an impregnation channel (53) making it possible to impregnate the applicator (38) with the product and a needle holder (12) equipped with a needle (13), the applicator holder (30) being translationally mobile with respect to the needle holder (12) between a position in which the needle (13) closes off the impregnation channel (53) and a position in which the impregnation channel (53) is open, an operating sleeve for the translational movement of the applicator holder (30) being provided, in which the operating device (40) is formed by a sleeve manually actuated in rotation with respect to the container (2), in which container the applicator holder (30) is moved longitudinally, this sleeve having a length such that, in the position for closing off the impregnation channel (53), the applicator (38) is entirely contained within the operating sleeve (40), the applicator (38) being a brush formed by a ring of bristles fixed annularly around the impregnation channel (53).

6 Claims, 2 Drawing Sheets

ASSEMBLY FOR THE DISPENSING AND THE APPLICATION OF A FLUID PRODUCT

The present invention relates to an assembly for the dispensing and the application of a fluid product.

Assemblies are known for applying and for dispensing a fluid product, into which are fixed, on the neck of a flexible or rigid container, an applicator holder equipped with an applicator, in particular a brush, the applicator holder, and possibly the applicator, being equipped with a channel for impregnating the applicator with the product. Such assemblies are used for the dispensing, for example, of nail varnish, adhesive, wax polish or ink.

However, in these assemblies accidental dispensing of product into the applicator often occurs between two operations and, consequently, the product runs the risk of fouling its surroundings if the assembly remains open between two operations. In addition, the user runs the risk of dirtying his/her hands when he/she operates the application and dispensing assembly.

In order to avoid this drawback, it has been proposed in EP-A-0,238,391 to close off the impregnation channel, rendering the applicator holder translationally mobile between a position in which the impregnation channel is closed off by the applicator holder and a position in which this impregnation channel is open, the applicator being protected, after application, in its position in which it closes off the impregnation channel; unfortunately, the applicator according to this document is a porous wick, continuously imbibed with product to be applied by capillary effect, the make-up of which, having a high head loss, makes it possible to retain the product contained in the impregnation channel and to drive it back into the container when the applicator holder is returned towards its retracted position in which it is protected; thus, such an assembly is not suitable when the applicator is a brush formed by a ring of bristles fixed around the impregnation channel.

An assembly has been proposed in U.S. Pat. No. 4,279,527 in which the applicator is a brush consisting of a ring of bristles fixed around the impregnation channel, in which the impregnation channel is closed off with the aid of a needle, the applicator holder being translationally mobile with respect to the needle holder between a position in which the needle closes off the impregnation channel and a position in which this impregnation channel is open. However, the assembly described in U.S. Pat. No. 4,279,527 does not make it possible to protect the applicator after application in order to prevent the product remaining on the applicator from drying too quickly and from fouling articles with which the applicator came into contact.

The subject of the invention is, consequently, an assembly for the dispensing and the application of a fluid product, comprising a container containing the product, an applicator holder equipped with an applicator, an impregnation channel making it possible to impregnate the applicator with the product and a needle holder equipped with a needle, the applicator holder being translationally mobile with respect to the needle holder between a position in which the needle closes off the impregnation channel and a position in which the impregnation channel is open, an operating device for the translational movement of the applicator holder being provided, characterized in that the operating device is formed by a sleeve actuated manually in rotation with respect to the container, in which sleeve the applicator holder is moved longitudinally, this sleeve having a length such that, in the position for closing off the impregnation channel, the applicator is entirely contained within the operating sleeve, the applicator being a brush formed by a ring of bristles fixed annularly around the impregnation channel.

Consequently, in the assembly of the invention, the applicator holder is set into a translational movement both with respect to the operating sleeve and with respect to the needle holder between two positions, a position in which the impregnation channel is closed off and in which the applicator is entirely contained in the operating sleeve, and a position in which the impregnation channel is open and in which the applicator is withdrawn from the operating sleeve so as to make the application of the product possible.

Preferably, according to the invention, the operating sleeve carries an internal thread interacting with an external thread of the applicator holder, the applicator holder being rotationally blocked. Advantageously, the external thread of the applicator holder possesses only one to two turns which move between those turns of the internal thread of the operating sleeve closest to the container and those turns furthest away from the container. Advantageously, the applicator holder is rotationally blocked by a fin integral with the said applicator holder and arranged in a slot made in the needle holder which is stationary since it is integral with the container.

According to a preferred embodiment, the assembly of the invention possesses a cap capable of covering the end of the operating sleeve when the applicator is in the position for closing off the impregnation channel. This cap advantageously possesses a sealing skirt extending towards the inside of the cap and capable of bearing on the end of the operating sleeve containing the applicator in the position for closing off the impregnation channel.

In order to make the invention better understood, the description of an embodiment of a dispensing and application assembly according to the invention, illustrated in the appended drawing be given hereinbelow, by way of non-limiting illustration.

Figure 1:
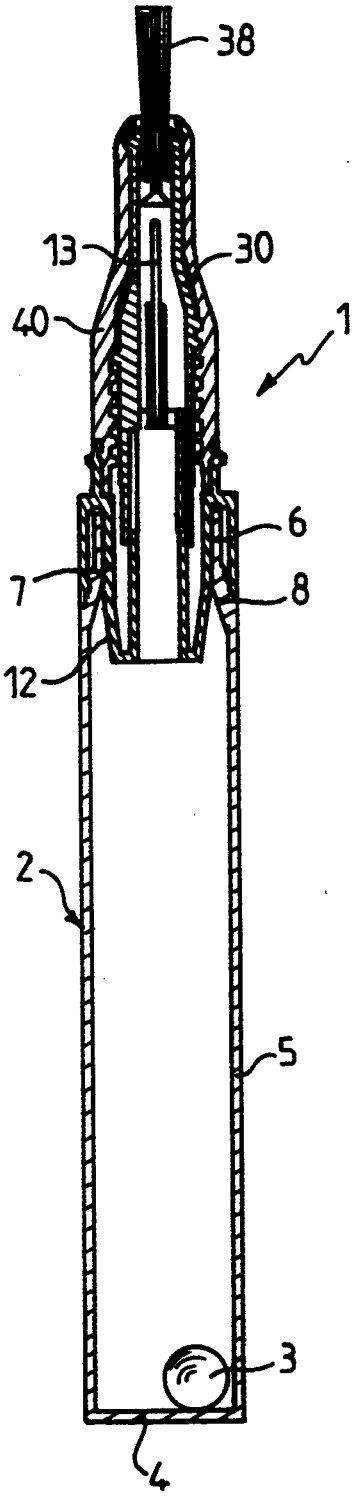
FIG. 1 is a longitudinal sectional view of a dispensing assembly, according to the invention, in the application position.
Figure 2:
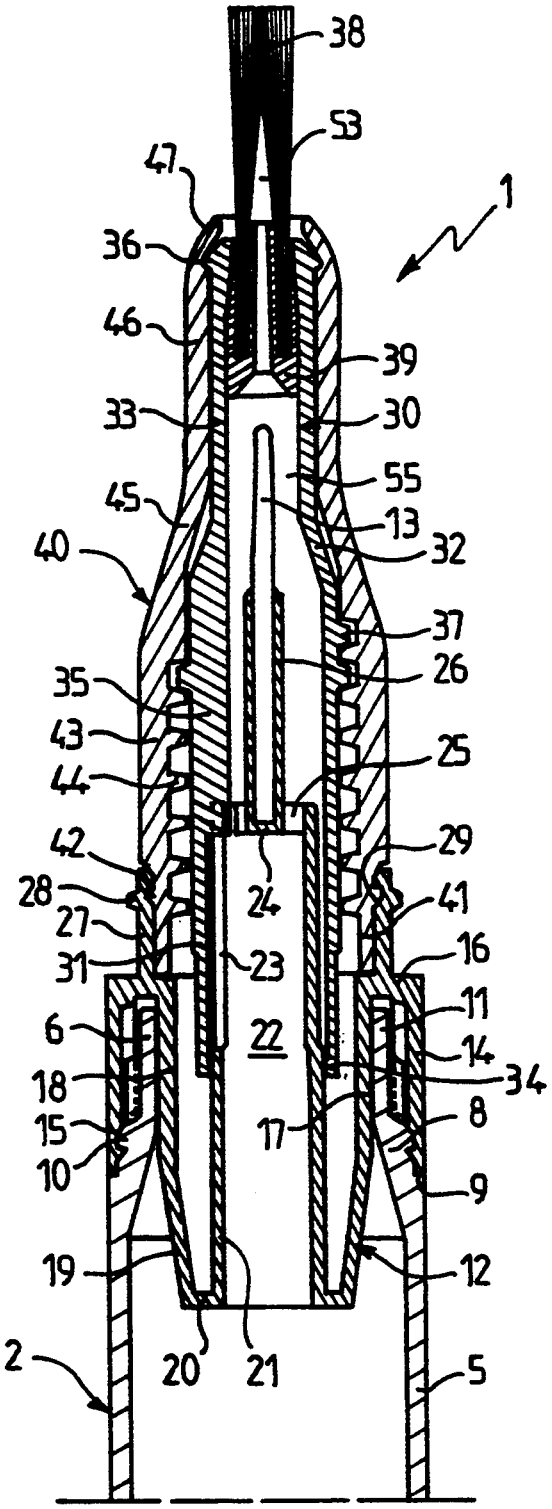
FIG. 2 is an enlarged longitudinal sectional partial view of the assembly in the application position.

The assembly shown in FIG. 1, designated by the reference 1, is an assembly for dispensing and applying nail varnish. It is formed by an axisymmetric cylindrical semi-rigid container 2 capable of containing the nail varnish. According to the embodiment shown, a ball 3 is arranged in the container 2, this ball being intended for stirring up the varnish and for putting the pigments contained in this varnish into suspension. The container 2 is equipped with a bottom 4, with a cylindrical side lateral wall 5 and, on the side opposite the bottom 4, with a neck 6 making an opening 7. The neck 6 is formed, on the one hand, by a frustoconical skirt 8 attached to the cylindrical wall 5 of the container 2 by a shoulder 9 perpendicular to the axis of the container and carrying a snap-fitting bead 10 and, on the other hand, by a cylindrical skirt 11 having the same diameter as the smallest-diameter part of the frustoconical skirt 8 (see FIGS. 2 and 3).

Figure 4:
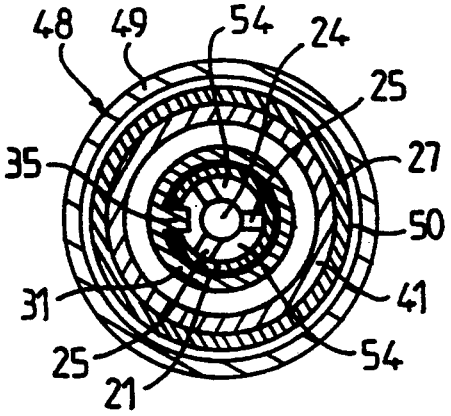
FIG. 4 is a cross-sectional view on the line (IV—IV) of FIG. 3.

A needle holder 12 carrying a metal needle 13 is fixed onto the neck 6 of the container 2. The needle holder can therefore be moved neither translationally nor rotationally with respect to the container 2. The needle holder 12 possesses an external cylindrical portion 14, a free end of which rests on the shoulder 9 of the neck and which has an external diameter equal to the external diameter of the cylindrical wall 5 of the container 2. The internal face of the portion 14 is equipped with an annular groove 15 capable of interacting, by snap-fitting, with the bead 10 of the neck 6 of the container 2. The external portion 14 is connected, via an annular collar 16 perpendicular to the longitudinal axis of the container, to a sealing skirt 17 possessing a cylindrical part 18 having an external diameter equal, to within the clearance necessary for fitting it, to the internal diameter of the cylindrical skirt 11 of the neck 6 of the container 2. The cylindrical part 18 of the sealing skirt 17 is prolonged by a frustoconical part 19 towards the bottom 4 of the container 2. The frustoconical part 19 of the sealing skirt 17 is connected via a collar 20 transverse to a sleeve 21, extending towards the outside of the container 2, making a passage 22 for the varnish to be dispensed. A longitudinal slot 23 is made in the sleeve 21. The end of the sleeve 21, outside the container, carries a hub 24 which is connected to the said sleeve 21 via three arms 25; three openings 54 (see FIG. 4) are thus made between the arms 25, the hub 24 and the sleeve 21. Fixed onto the hub 24 is a tube 26 into which the needle 13 is forcibly pushed. The needle holder 12 also possesses, on the collar 16, a skirt 17 for fixing the operating sleeve 40 having a diameter close to the diameter of the opening of the neck 6 and carrying, on its external face, an external annular bead 28 and, on its internal face, an internal annular groove 29.

Slipped over the sleeve 21 is an applicator holder, in this case therefore a brush holder 30, carrying a brush 38, capable of being moved translationally, longitudinally, by sliding over the sleeve 21. The brush holder 30 is made up of a first cylindrical element 31 having, to within the necessary clearance, an internal diameter equal to the external diameter of the sleeve 21, this first cylindrical element 31 carrying, at its end facing the inside of the container, a sealing lip 34 interacting, in a sealed manner, with the outer surface of the sleeve 21. At its other end, the first cylindrical element 31 is connected to a frustoconical element 32 of diameter decreasing outwards and connected to a second cylindrical element 33 having a smaller diameter than the first element 31. A radial fin 35, the internal edge of which is parallel to the longitudinal axis of the assembly, is arranged on the frustoconical element 32 and on part of the first cylindrical element 31. This fin 35 is capable of interacting with the slot 23 in the sleeve 21 of the needle holder 12. The external wall of the first cylindrical element 31 of the brush holder 30 is equipped with a helical thread of one and a half turns. The end facing the outside of the brush holder 30 carries a sealing bead 36. The brush 38 is formed by an annular clip 39 in which a ring of bristles is clamped, the clip making a channel 53. The clip 39 is forcibly engaged in that end, facing the outside of the element 33, of smaller diameter, of the brush holder 30.

The brush holder 30 is surrounded by an operating sleeve 40 fixed onto the fixing skirt 27 for the needle holder 12. This sleeve 40 possesses a first cylindrical element 41, of small thickness, equipped with an annular snap-fastening bead 42 interacting with the annular groove 29 in the fixing skirt 27 so that the operating sleeve 40 can rotate with respect to the needle holder 12 and, consequently, with respect to the container 2. The second cylindrical element 43 is thicker than the first cylindrical element 41; the internal surfaces of the cylindrical element 41 and of the second cylindrical element 43 are in the extension of each other, and the external surface of the second cylindrical element 43 is in the extension of the external surface of the fixing skirt 27.

The internal surface of the cylindrical elements 41 and 43 carries a thread 44 intended to interact with the thread 37 of the cylindrical element 31 of the brush holder 30. A third element 45 of the operating sleeve 40 is a frustoconical element of the same angle at the vertex as that of the frustoconical element 32 of the brush holder 30 and a fourth element 46 is a cylindrical element having an internal diameter equal, to within the necessary clearance, to the external diameter of the cylindrical element 33 of the brush holder 30. The cylindrical element 46 is extended outwards into a frustoconical collar 47.

A cap 48 (FIG. 3) protects the operating sleeve 40 and the brush 38 contained in the said sleeve 40. The cap 48 possesses a cylindrical fixing skirt 49, the outside diameter of which is the same as that of the container 2 and of the external skirt 14 of the needle holder 12 and carries, on its internal face, a snap-fastening bead 50 capable of interacting with the external bead 28 of the skirt 27 for fixing the needle holder 12. A sealing skirt 52 is carried by the top 51 of the cap 48 and bears, when the cap 48 is in place, on the cylindrical element 46 of the operating sleeve 40.

The dispensing and application assembly 1 operates in the manner described hereinbelow.

Figure 3:
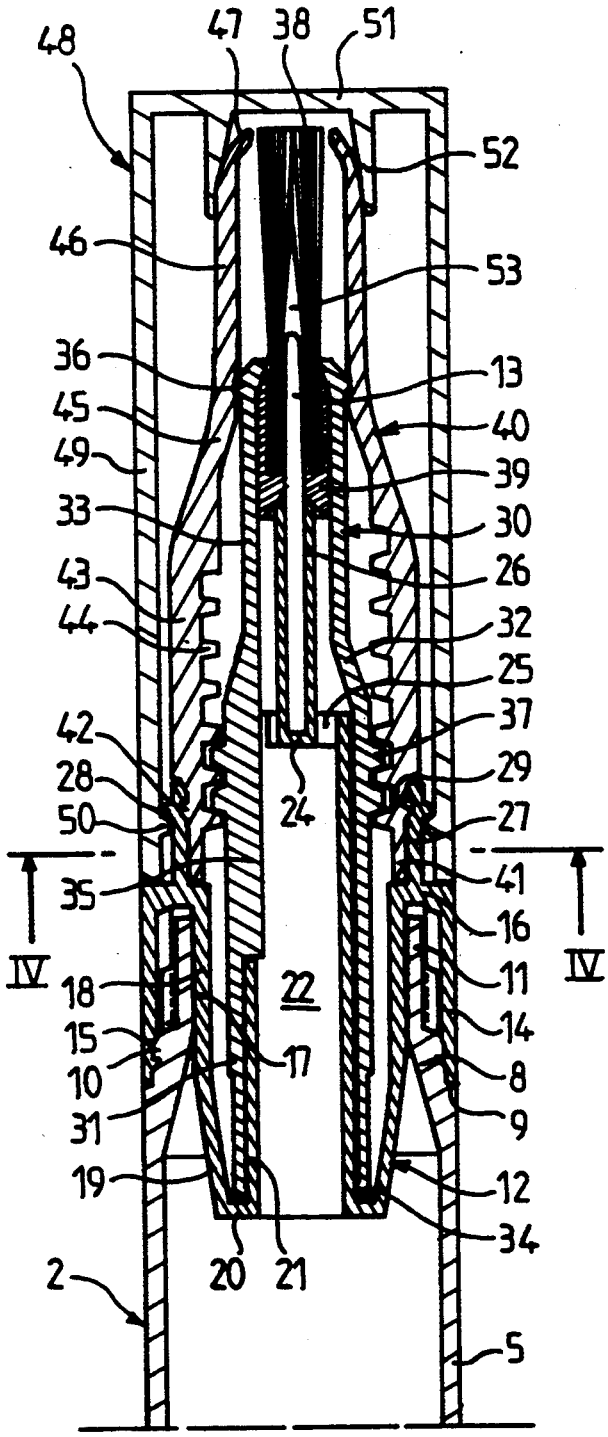
FIG. 3 is an enlarged longitudinal sectional partial view in the storage positions.

In the storage position, as illustrated in FIG. 3, the cap 48 is fixed onto the needle holder 12 and the brush holder 30 is arranged in such a manner that the fin 35 is in abutment at the bottom of the slot 23 in the needle holder 12 and that the thread 37 of the brush holder 30 interacts with those turns of the thread 44 of the operating sleeve 40 closest to the container. The brush is then entirely contained within the cylindrical element 46 of the operating sleeve 40. The needle 13 closes off the channel 53 of the brush 38.

When the user wishes to apply the product contained in the container 2, he/she removes the cap 48, thereby releasing the operating sleeve 40. Next, he/she manually rotates the said operating sleeve 40 with respect to the container. By action of the thread 44 of the operating sleeve 40 on the thread 37 of the brush holder 30, which cannot rotate since it is blocked by the fin 35 arranged in the slot 23 in the needle holder 12, the brush holder 30 is set into an outward translational movement along the axis of the assembly, the element 31 of the brush holder 30 sliding over the sleeve 21 of the needle holder 12 and the element 33 sliding in the element 46 of the operating sleeve 40. The brush 38 emerges from the element 46 of the operating sleeve 40 and the channel 53 comes clear of the needle 13. The product contained in the container 2 can then pass via the passage 22, made by the sleeve 21 of the needle holder 12, through the openings 54 between the hub 24 and its arms 25 for fixing to the sleeve 21, through the internal space 55 in the brush holder 30 around the needle 13 and, finally, through the channel 53 of the brush 38 (see FIG. 2). At the end of the travel, the brush holder 30 butts up against the collar 47 of the operating sleeve 40, the frustoconical elements 32 of the brush holder 30 and 45 of the operating sleeve 40 are arranged one against the other and the thread 37 of the brush holder interacts with the outermost turns of the thread 44 of the operating sleeve 40. When the user wishes to apply the varnish to his nails, he/she exerts with his/her thumb and index finger a slight pressure on the body of the semi-rigid container 2, the brush 38 of the applicator assembly 1 facing downwards. The product then impregnates the bristles of the brush 38 and the varnish can be applied to the nails.

After having applied the product, the user rotates the operating sleeve 40 with respect to the container 2 so as to give the brush holder 30 a translational movement which is the reverse of the previous movement until the brush holder 30 comes back into its storage position. It should be noted that, even if the cap 48 is not put on immediately, the varnish contained in the container 2 cannot be accidently dispensed: the needle 13 closes off the channel 53 of the brush 38, and the brush 38, protected by the operating sleeve 40, cannot come into contact with articles around it and dirty them.

I claim:

1. Assembly for the dispensing and the application of a fluid product, comprising a container (2) containing the product, an applicator holder (30) equipped with an applicator (38), an impregnation channel (53) making it possible to impregnate the applicator (38) with the product and a needle holder (12) equipped with a needle (13), the applicator holder (30) being translationally mobile with respect to the needle holder (12) between a position in which the needle (13) closes off the impregnation channel (53) and a position in which the impregnation channel (53) is open, an operating device for the translational movement of the applicator holder (30) being provided, characterized in that the operating device (40) is formed by a sleeve actuated manually in rotation with respect to the container (2), in which sleeve the applicator holder (30) is moved longitudinally, this sleeve having a length such that, in the position for closing off the impregnation channel (53), the applicator (38) is entirely contained within the operating sleeve (40), the applicator (38) being a brush formed by a ring of bristles fixed annularly around the impregnation channel (53).

2. Assembly according to claim 1, characterized in that the operating sleeve (40) carries an internal thread (44) interacting with an external thread (37) of the applicator holder (30), the applicator holder (30) being rotationally blocked.

3. Assembly according to claim 2, characterized in that the external thread (37) of the applicator holder (30) possesses only one to two turns.

4. Assembly according to claim 2, characterized in that the applicator holder (30) is rotationally blocked by a fin (35) integral with the said applicator holder (30) and arranged in a slot (23) made in the needle holder (12).

5. Assembly according to one of claim 1, characterized in that it possesses a cap (48) capable of covering the end of the operating sleeve (40) when the applicator (38) is in the position for closing off the impregnation channel (53).

6. Assembly according to claim 5, characterized in that the cap (48) carries a sealing skirt (52) capable of bearing on the end of the operating sleeve (40).

* * * * *